United States Patent [19]

Silverman

[11] Patent Number: 4,882,966

[45] Date of Patent: Nov. 28, 1989

[54] MUSICAL JEWELRY BOX

[76] Inventor: Barry Silverman, 3 Melrose Ln., West Nyack, N.Y. 10994

[21] Appl. No.: 339,730

[22] Filed: Apr. 18, 1989

[51] Int. Cl.[4] ..... G10F 1/06

[52] U.S. Cl. ..... 84/94.2; 206/566

[58] Field of Search ..... 84/94.1, 94.2, 95.1, 84/95.2; 206/314, 566; 224/910

[56] References Cited

U.S. PATENT DOCUMENTS

| | | | |
|---|---|---|---|
| 2,800,048 | 7/1957 | Anderson | 84/95.2 |
| 3,937,320 | 2/1976 | Chao et al. | 206/566 X |
| 4,732,269 | 3/1988 | Roy | 206/566 X |
| 4,801,478 | 1/1989 | Greenblatt | 84/94.2 X |

FOREIGN PATENT DOCUMENTS

| | | | |
|---|---|---|---|
| 280210 | 4/1952 | Switzerland | 84/95.2 |

*Primary Examiner*—L. T. Hix
*Assistant Examiner*—Brian W. Brown
*Attorney, Agent, or Firm*—Darby & Darby

[57] ABSTRACT

The present invention provides a musical jewelry box that includes a box formed by a pair of sections, each having an open cavity and a rim defining an opening to the cavity, said sections being joined along a hinge. Preferably, the rim of the second section has an inwardly stepped configuration that is designed to be inserted into the rim of the first section when the box is closed. A push button switch, activated by a lever arm connected to the switch, is mounted on the inner surface of the first section with the end of the lever extending from the rim. When the box is closed, the lever is depressed by the edge of the rim of the second section. The opening of the box releases pressure from the lever to reset the switch. An electronic musical tone generating device, located within the first section, is connected to the switch and is activated by the switch when the box is open and deactivated by the switch when the box is closed. A liner, inserted into the cavity of the first section hides the switch and the musical tone generating device. The liner is provided with a freely deformable portion covering the end of the lever so that pressure may be exerted against the lever, by the edge of the second section, when the box is closed.

11 Claims, 2 Drawing Sheets

FIG. 1
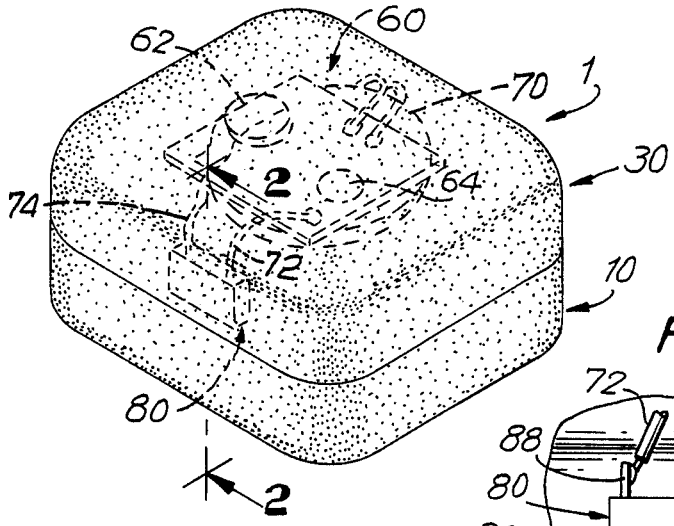
FIG. 3
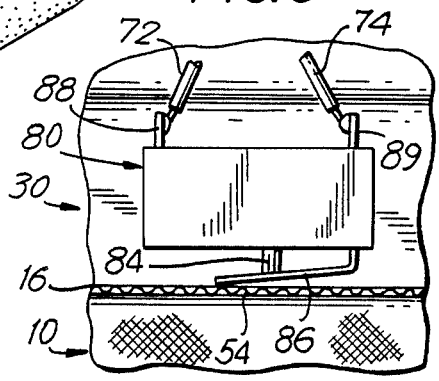
FIG. 2
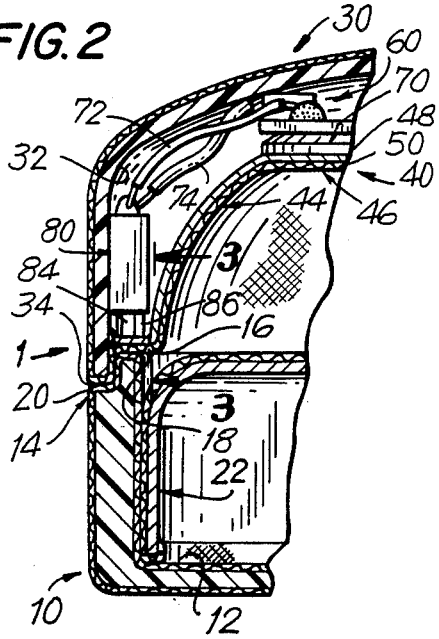
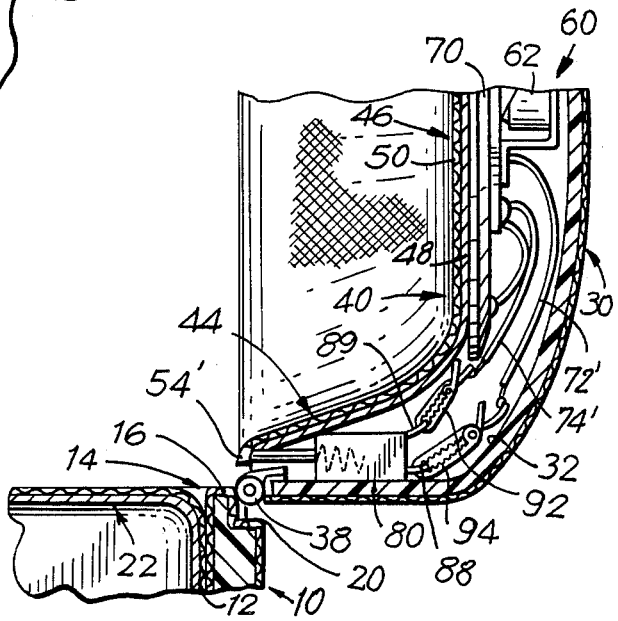
FIG. 7

MUSICAL JEWELRY BOX

FIELD OF THE INVENTION

The present invention relates to jewelry boxes that are used to display and store jewelry, and more particularly, to a jewelry box having a pair of opposed sections, which are in a clam shell configuration, joined along a hinge, when the box is open and a music generating mechanism, in one of the sections, activated when the box is opened to generate a melody. Even more particularly, the present invention relates to such a musical jewelry box in which the music generating mechanism is hidden from view, when the box is open, by a liner.

BACKGROUND OF THE INVENTION Jewelry boxes are mass produced items that are used to display and store jewelry, such as rings, earrings, pendants, etc. Generally, such jewelry boxes have a pair of separable top and bottom sections, hinged together in a clam shell-like arrangement for opening and closing the box. Since jewelry is often purchased as a gift, it is necessary for the interior of the jewelry box to present an aesthetically pleasing appearance to visually offset and highlight the gift when the jewelry box is first opened by the recipient of the gift. To this end, each section of the jewelry box is provided with a liner formed from an essentially rigid cardboard backing piece and a layer of fabric, such as satin, covering the backing piece. The fabric layer provides the interior of the jewelry box with the necessary, aesthetically pleasing appearance.

As will be discussed, the present invention provides a jewelry box, as described above, incorporating a music generating mechanism that is activated and deactivated by the opening and closing of the jewelry box. In this regard, the prior art has long provided finely crafted music boxes in which a box having base and lid portions is provided with a spring driven mechanism to generate an audibly perceivable melody. The mechanism of such a music box is normally located within a compartment in the base portion and is activated and deactivated by a depressible plunger extending from an aperture in the base portion. When the lid portion is fitted over the base portion, the plunger is depressed by the lid portion to deactivate the mechanism; and when the lid portion is removed, the plunger freely extends to activate the mechanism so that the melody may be heard.

More recently, the prior art has provided musical greeting cards that contain inexpensive, miniature electronic mechanisms to generate audibly perceivable, musical tones. Such mechanisms include circuitry for generating a signal for producing a melody, a small nickel cadmium battery for powering the circuitry, a miniature acoustical speaker responsive to the signal for producing the melody, and a switch to activate and deactivate the electronic circuitry.

In such musical greeting cards, the electronic circuitry, battery, switch, and speaker are enclosed within one of the leaves of the card. The switch includes a spring loaded contact set that is separated by an insulative strip having an aperture. The insulative strip extends from an opposite leaf of the card, such that, when the card is opened, the insulative strip slides between the contacts until the aperture is positioned between the contacts to allow the switch to close and thereby actuate the electronic circuitry.

In both music boxes incorporating spring driven mechanical mechanisms and musical greeting cards employing miniature electronic circuitry, each mechanism or circuit is capable of producing a single melody. The only way to change the melody is to replace the mechanism or the circuit with another mechanism or circuit capable of producing a new melody.

Problems exist in adapting the prior art, as discussed above, to conventional jewelry box designs. Although, in conventional jewelry box designs, there exists a space between the interior of each of the sections and the liners associated with the sections, in which a prior art music generating mechanism could be contained, an unsightly aperture would have to be provided in at least one of the liners. For instance, an aperture in one of the liners would be required for the plunger of a spring driven music generating mechanism; and possibly an aperture in each of the liners would be required to allow the strip of a greeting card type electronic music generating mechanism to slide between the sections. Another problem relates to the fact that jewelry is often given as a gift to mark special occasions. Since, as mentioned above, the only way to change the melody of prior art music generating mechanisms is by replacement, a separate line of boxes would be needed to produce a melody appropriate to each occasion. For instance, a line of boxes would have to be produced to play wedding marches for engagement gift, another line of boxes would have to be produced to play birthday marches for birthday gifts, etc. The separate production of each line of boxes would increase the unit cost of the boxes over conventional jewelry boxes because of the increased assembly costs in adding the music generating mechanism to each box and the allocation of separate lines of production to produce separate lines of jewelry boxes, each capable of playing music appropriate to specific gift giving occasions, even though the boxes, except for the music generating mechanism, would be identical.

SUMMARY OF THE INVENTION

The present invention provides a musical jewelry box having a box for containing jewelry. The box includes a pair of separable first and second sections having a pair of opposed open cavities and a pair of corresponding rims defining openings to the cavities. The rims are in contact with one another when the box is closed, and are separated from one another when the sections are separated, in clam shell fashion, to open the box.

Actuable music generating means are located within the cavity of a first section, for generating a melody. Switch means, having pressure activated means for deactivating the music when pressure is applied and for activating the music means when pressure is released, are connected to the first section with the pressure activated means adjacent to the rim of the first section. Connection means, located within the cavity of the first section, are provided for connecting the switch means to the music means.

Essentially rigid liner means are inserted within the cavity of the first section to provide a compartment within the cavity for containing and thereby hiding the music generating means, switch and connection means from view when the box is open. The liner means includes deformable means, covering the pressure activated means, for transmitting pressure to the pressure activated means. Pressure applying means, associated with the second section, are provided for applying pressure to the pressure activated means, through the deformable means, when the box is closed to deactivate the music means. The incorporation of the deformable portion into the liner means obviates the necessity of there being a hole or aperture formed in the liner for plungers, strips and like components.

The connection means may be removable to allow separation of the music generation means from the switch means. The music generation means may also be connected to the liner and the liner means may also be removable to allow for substitution of the liner means and the music generation means as a single unit. This latter aspect of the present invention allows the musical jewelry box to be manufactured such that each box is not allocated to a specific gift occasion. Manufacturing costs are reduced because the present invention contemplates that the jewelry retailer will complete final assembly of the box by inserting a liner having a pre-attached music generating mechanism, or a separate music generating means, capable of generating a melody appropriate to the occasion of the gift.

DESCRIPTION OF THE DRAWINGS

In the accompanying Drawings:

FIG. 1 is a perspective view of a musical jewelry box in accordance with the present invention illustrated in a closed position.

FIG. 2 is a cross-sectional view of FIG. 1 taken along the line 2—2 of FIG. 1.

FIG. 3 is a cross sectional view taken along the line 3—3 of FIG. 2.

FIG. 7 is a fragmentary, sectional view of an alternative embodiment of a musical jewelry box in accordance with the present invention.

DETAILED DESCRIPTION OF THE INVENTION

Figure 4:
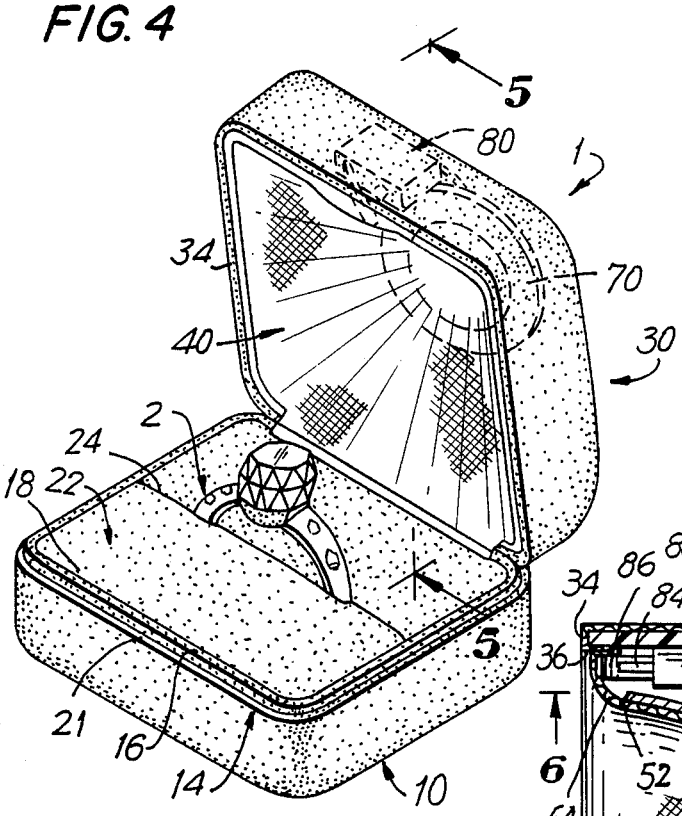
FIG. 4 is a perspective view of the jewelry box of FIG. 1 illustrated in an open position.

With reference to FIGS. 1, 2 and 4, a preferred embodiment of a musical jewelry box 1 is respectively illustrated in open and closed positions. For exemplary purposes, jewelry box 1 contains a diamond engagement ring 2 mounted in a bottom section 10 of jewelry box 1.

Bottom section 10 has a cavity 12 and a rim 14. Preferably, rim 14 has an inwardly stepped configuration and includes a peripheral edge 16 defining an opening 18 of cavity 20 and an outer stop surface 21 spaced below and surrounding peripheral edge 16. Preferably, a mounting liner 22 is received within container 10 in a close fitting relationship. Mounting liner 22 has a transverse slit 24 through which ring 2 is inserted for mounting in the bottom section 10.

Figure 5:
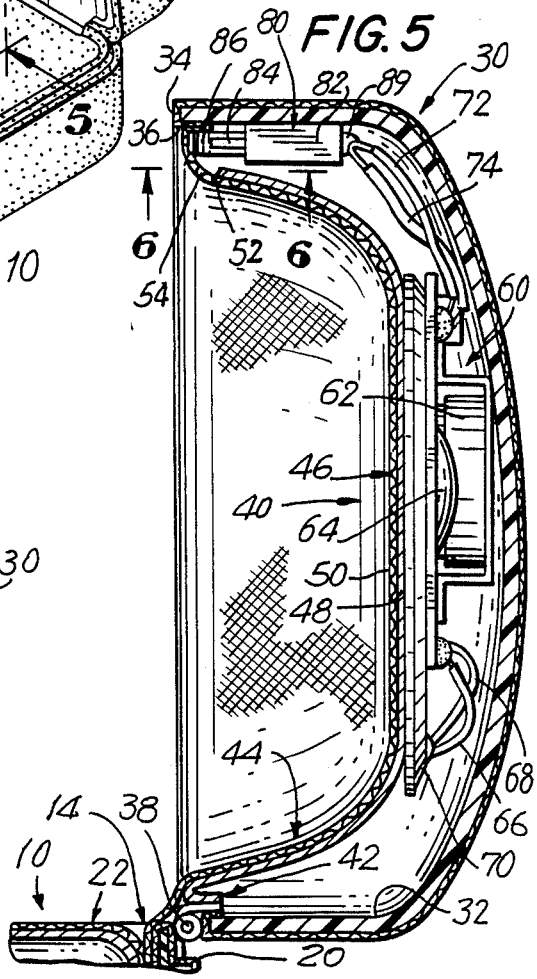
FIG. 5 is a cross-sectional view of FIG. 4 taken along line 5—5.

With additional reference to FIG. 5, a top section 30 is provided. Top section 30 has an open cavity 32 and a rim formed by a peripheral edge 34 that defines an opening 36 to cavity 32. The rim of top section 30 is configured to contact rim 14 of bottom section 10 when the musical jewelry box 1 is closed. In this regard, when jewelry box 1 is in a closed position, peripheral edge 34 contacts stop surface 21 and peripheral edge 16 of rim 14 is received within cavity 32. Preferably top section 30 is hinged to bottom section 10 by a hinge 38 such that top and bottom sections 10 and 30 are pivoted toward and away from one another in opening and closing jewelry box 1.

Top section 30 is provided with a liner 40 having an outer edge portion 42 in contact with the inner surface of top section 30 and adjacent to peripheral edge 34. Liner 40 is provided with an arcuate sidewall portion 44 extending from outer edge portion 42 into cavity 32. Top wall portion 46 is inwardly spaced from outer edge portion 42 and is connected to sidewall portion 44. Liner 40 is configured such that a compartment in cavity 32 is formed by the space existing between sidewall portion 44, basewall portion 46 and the inner surface of top section 30.

Preferably, liner 40 is formed from an inner cardboard backing layer 48 and an outer, freely deformable fabric layer 50 secured to cardboard backing layer 48. Although liner 40 may be permanently affixed to top section 30, as will be discussed, hereinafter, liner 40 may be frictionally engaged with the inner surface of top section 30., along outer edge portion 42, to allow removal of liner 40. Additionally, for reasons that will become apparent, cardboard backing layer 48 is provided with a cutout 52 inwardly extending from outer edge portion 42 so as to overlie peripheral edge 16 of rim 14 when musical jewelry box 1 is closed. The absence of cardboard backing layer 48 in cutout 52 provides sidewall portion 44 with a freely deformable section 54, by virtue of deformable fabric layer 50 covering cutout 52. As illustrated, deformable section 54 is located opposite to hinge 38.

Preferably, a musical tone is generated by a miniature, electronic device 60 that is well known in the art and that is readily obtainable. Device 60 includes a nickel cadmium battery 62 powering a miniature circuit 64. Circuit 64 generates a signal referable to the musical tone to be produced. A pair of conductive output leads 66 and 68 transmit the signal to a miniature speaker 70. The device 60 and speaker 70 are connected to top wall portion 46 and are located within the space between top wall portion 46 and the inner surface of top section 30.

Figure 6:
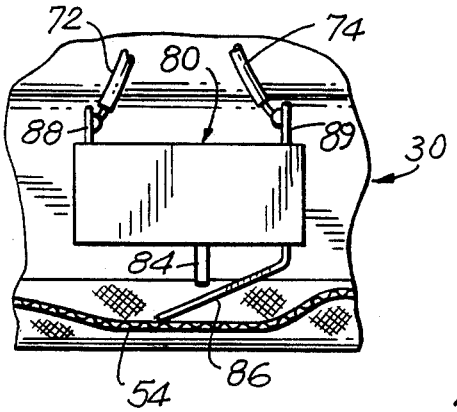
FIG. 6 is a cross-sectional view taken along the line 6—6 of FIG. 5.

With additional reference to FIGS. 3 and 6, a pair of control terminal leads 72 and 74 extend from electronic device 60. Although not illustrated, but as well known in the art, one of the control leads 72 is connected directly to circuit 64. The battery 62 is connected in series between circuit 64 and control lead 74. When the two control leads 72 and 74 are shunted, a circuit is completed between battery 62 and circuit 64 to activate device 60 such that a musical tone emanates from speaker 70. When the aforementioned circuit is open, since no current flows to circuit 64, device 60 is deactivated.

The opening and the closing of the power circuit, described above, is preferably effectuated by single pole, single throw, lever activated push button switch 80, normally set in the circuit closed position. Switch 80 has a switch housing 82, and a depressible push button 84, extending from housing 82, that is depressed by a spring-like lever arm 86 connected, at one end, to switch housing 82 adjacent to push button 84. When pressure is exerted on the other end of arm 86, arm 86 acts as a lever to depress push button 84 and set switch 80 in a circuit open position. Switch 80 is also provided with switch terminals 88 and 89 extending from switch housing 82 and connected to the ends of control leads 72 and 74.

Switch 80 is connected to top section 30 so that the end of lever arm 86 contacts deformable portion 54 of insert 40. When box 1 is closed, the peripheral edge 16 of the rim of the bottom section bears against the end of lever arm 86 with a pressure that depresses push button 84 to set switch 80 into the circuit open position. As a result, no current flows from battery 62 to circuit 64 and device 60 is deactivated. When box 1 is opened, switch 80 reverts to its circuit closed position; and, as a result, a musical tone emanates from speaker 70 of device 60.

With reference to FIG. 7, as an alternative embodiment a freely deformable section 54' of liner 40 is provided adjacent to hinge 38. Additionally, control leads 72' and 74' may be provided with alligator clips 92 and 94 to permit removal of leads 72' and 74' from switch terminals 88 and 89. Additionally, as indicated previously, since liner 50 is also preferably removable, liner 50 and device 60 can be removed, or inserted in the first instance, in accordance with the type and purpose of gift that is being displayed in musical jewelry box 1. For instance, in the illustrated embodiment, since the gift is an engagement ring 2, liner 40 has a pre-attached device 60 that generates a wedding march. In the event that a birthday gift, such as a pendant, were being dispensed, then a liner having a pre-attached device 60 to generate a birthday march would be substituted and inserted into top section 30. Preferably, the boxes and liners having pre-attached music generating devices, would be supplied to the jewelry retailer as separate components to be assembled by the retailer. It will be appreciated that the alligator clips and replacable generator can be used whether or not the liner is attached to the generator.

In the preferred embodiment, device 60 and switch 80 are contained within top section 30 and are hidden by liner 40 associated with top section 30. The reason for this is that in the particular preferred design of jewelry box 1, ring 2 projects into the cavity of bottom section 10; and as such, there is not enough space for device 60 between the liner 22 and the inner surface of bottom section 10. However, as may be appreciated, in a jewelry box design in which articles did not project into the cavity of the bottom section, it would be possible to provide a switch and a musical tone generating device in the bottom section of such a box. As may also be appreciated, the top section of such a jewelry box would have to be provided with means for exerting pressure against the switch, upon closure of the box. Such means could be formed by providing the top section of such a box with the rim 14 of the bottom section 10 of the preferred embodiment and the bottom section of such a box with the rim of the top section 30 of the preferred embodiment.

Furthermore, the present invention may be adapted for switch designs, other than the switch illustrated herein as switch 80. For instance, the switch might be of the type in which a pair of contacts are mounted on the ends of a pair of parallel deformable arms. A plunger, extending from the bottom section of the box would be provided to act against the deformable portion of the liner to close the contacts.

While specific embodiments of the invention have been shown, the invention should not be considered as so limited, but only as limited as set forth in the appended claims.

I claim:

1. A musical jewelry box comprising:

a box for containing jewelry including first and second sections joined by a hinge and having a pair of opposed open cavities and a pair of opposed, corresponding rims defining openings to said cavities, said sections contacting one another when said box is closed, and separated from one another, when said section are opened in clam shell fashion along the hinge;

actuatable music means, located within said cavity of said first section, capable of generating a melody;

switch means, having pressure activated means for deactivating said music means when pressure is applied and for activating said music means when pressure is released, said switch means connected to said first section, within said cavity, with its said pressure activated means located adjacent to said rim of said first section;

connection means, located within said cavity of said first section, for connecting said switch means to said music means;

essentially rigid liner means inserted within said cavity and providing a compartment within said cavity for containing and thereby hiding said music means, switch and connection means from view when said box is open, and including deformable means, covering said pressure activated means, for transmitting pressure to said pressure activated means; and pressure applying means, associated with said second section and acting against said deformable means, for applying pressure to said pressure activated means when said box is closed in order to deactivate said music means.

2. The jewelry box of claim 1, wherein:

said connection means is separable from said switch means to allow separation of said music generation means from said switch means;

said music generation means is connected to the said liner; and said liner means is removable to allow for substitution of said liner means and said music generation means as a single unit.

3. The jewelry box of claim 1, wherein:

each of said rims has a peripheral edge; and said rim of said second section has an inwardly stepped configuration and includes a stop surface spaced from and surrounding its said peripheral edge, and is configured to extend into said rim of said first section, when said box is closed, with its peripheral edge located within said cavity of said first section and exerting pressure through said deformable means, against said pressure activated means.

4. The jewelry box of claim 3, wherein:

said music means is electrically activated; and said switch means comprises a lever activated push button switch having a housing, and said pressure activated means includes a push button extending from said housing and a lever arm connected, at one end, to said housing so as to be operable to act against said push button when pressure is applied to the other end of said lever arm, said other end of said lever arm located adjacent to said rim of said first section, such that when said box is closed, said rim of said second section, at its said peripheral edge, applies pressure through said deformable means to said other end of said lever arm.

5. The jewelry box of claim 1 wherein:

said liner means has an outer edge portion in close contact with the inner surface of said first section and adjacent to said rim of said first section, an arcuate sidewall portion extending from said outer edge portion into said cavity of said first section, and a flat, top wall portion connected to said sidewall portion;

said sidewall and said top wall portions are formed by a cardboard backing layer and a deformable fabric layer secured to said cardboard backing layer.

said cardboard backing layer has a cutout defined in said sidewall portion and extending from said peripheral edge portion, such that said deformable fabric layer covers said cutout and forms said deformable means;

said compartment is formed between the inner surface of said first section and said side and top wall portions of said liner; and said music means is connected to said top wall portion.

6. The jewelry box of claim 5, wherein:

each of said rims has a peripheral edge;

the rim of said second section has an inwardly stepped configuration and includes a stop surface spaced from and surrounding its said peripheral edge; and said rim of said second section is configured to extend into said rim of said first section, when said box is closed, with its said peripheral edge within said cavity of said first section, and exerting pressure, through said deformable fabric within said cutout. against said pressure activated means.

7. The jewelry box of claim 6, wherein:

said music means is electrically activated; and said switch means comprises a lever activated push button switch having a housing and said pressure activated means includes a push button extending from said housing and a lever arm connected, at one end, to said housing so as to be operable to act against said push button when pressure is applied to the other end of said lever arm, said other end of said lever arm located adjacent to said one rim of said one section, such that when said box is closed, said rim of said second section, at its said peripheral edge, applies pressure through said deformable means to the other end of said lever arm.

8. The jewelry box of claim 7, wherein:

said liner is permanently affixed to said one section along its said outer edge portion;

said switch has a pair of switch terminals; and said connection means comprises a pair of conductive control leads connected, at one end, to said music generation means and, at the other end, to said switch terminals.

9. The jewlery box of claim 7, wherein:

said outer edge portion of said liner is frictionally engaged with the inner surface of said cavity so that said liner and music generation means may be removed from said first section as a single unit;

said switch has a pair of switch terminals; and said connection means comprises a means to removably connect said switch terminals to a pair of control wires connected, at one end, to said music generation means, such that said wires may be separated from said switch upon removal of said liner and music generation means from said first section.

10. The jewelry box of claim 8, wherein:

said sections are hingedly connected to one another such that said first section pivots toward and away from said second section when said box is closed and opened; and said deformable means is located opposite to the hinge connection of said sections.

11. The jewelry box of claim 9, wherein:

said sections are hingedly connected to one another such that said first section pivots toward and away from said second section when said box is closed and opened; and said deformable means is located adjacent to the hinge connection between said sections.

* * * * *